US011077671B2

(12) United States Patent
Wakasa et al.

(10) Patent No.: US 11,077,671 B2
(45) Date of Patent: Aug. 3, 2021

(54) LIQUID DISCHARGE DEVICE, IMAGE FORMING APPARATUS, AND FABRICATING APPARATUS

(71) Applicants: Ryohki Wakasa, Kanagawa (JP); Atsushi Mori, Tokyo (JP); Yuuichiroh Uematsu, Kanagawa (JP)

(72) Inventors: Ryohki Wakasa, Kanagawa (JP); Atsushi Mori, Tokyo (JP); Yuuichiroh Uematsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 16/677,490

(22) Filed: Nov. 7, 2019

(65) Prior Publication Data

US 2020/0147976 A1 May 14, 2020

(30) Foreign Application Priority Data

Nov. 14, 2018 (JP) ..... JP2018-213948

(51) Int. Cl.
*B41J 2/18* (2006.01)
*B41J 2/14* (2006.01)
*B41J 2/175* (2006.01)

(52) U.S. Cl.
CPC ..... *B41J 2/18* (2013.01); *B41J 2/14201* (2013.01); *B41J 2/175* (2013.01)

(58) Field of Classification Search
CPC ..... B41J 2/175; B41J 2/17596; B41J 29/38; B41J 2/18; B41J 2202/12; B41J 2/14201
See application file for complete search history.

(56) References Cited

U.S. PATENT DOCUMENTS

2010/0085396 A1* 4/2010 Yokota ..... B41J 2/175 347/7
2011/0216111 A1 9/2011 Katoh
2014/0268242 A1 9/2014 Kaneko et al.
2015/0110514 A1 4/2015 Mori et al.
2017/0108808 A1 4/2017 Matsue et al.
2017/0248889 A1 8/2017 Uematsu et al.
2018/0134033 A1* 5/2018 Sawase ..... B41J 2/18
2018/0150010 A1 5/2018 Sone et al.

FOREIGN PATENT DOCUMENTS

JP 2010-083021 4/2010
JP 2011-178060 9/2011
JP 2015-079147 4/2015
JP 2017-076031 4/2017
JP 2017-151330 8/2017
JP 2018-092114 6/2018

* cited by examiner

*Primary Examiner* — Jannelle M Lebron
(74) *Attorney, Agent, or Firm* — Duft & Bornsen, PC

(57) ABSTRACT

A liquid discharge device includes a storage tank, a discharge head, a liquid feeder, a supply tank, a liquid path, a branch path, and a flow regulator. The liquid feeder is configured to feed liquid from the storage tank to the discharge head in a liquid feed direction. The supply tank is disposed upstream of the discharge head in the liquid feed direction, to store the liquid fed by the liquid feeder while being in a state open to atmosphere. The liquid path is configured to flow the liquid from the liquid feeder to the supply tank. The branch path is connected to the liquid path and configured to cause part of the liquid to branch from the liquid path. The flow regulator is disposed downstream of the discharge head in the liquid feed direction and configured to control a flow rate of the liquid flowing into the discharge head.

16 Claims, 8 Drawing Sheets

LIQUID DISCHARGE DEVICE, IMAGE FORMING APPARATUS, AND FABRICATING APPARATUS

CROSS-REFERENCE TO RELATED APPLICATION

This patent application is based on and claims priority pursuant to 35 U.S.C. § 119(a) to Japanese Patent Application No. 2018-213948, filed on Nov. 14, 2018, in the Japan Patent Office, the entire disclosure of which is hereby incorporated by reference herein.

BACKGROUND

Technical Field

The present disclosure relates to a liquid discharge device, an image forming apparatus, and a fabricating apparatus.

Discussion of the Background Art

There is an increasing demand for printing of a small number of copies the printing industry these days. In offset printing, it is necessary to create a plate. Therefore, in printing a small number of copies, there is the problem of increases in the costs of creating a plate and the time required to create the plate. On the other hand, printing with an ink jet printer that is an image forming apparatus that performs image formation by discharging ink is advantageous in terms of both cost and time.

In an ink jet printer, when the viscosity of ink becomes higher, the edge of the discharge head is clogged with the ink. As a result, the discharge head cannot discharge the ink, and an image quality defect occurs. Therefore, techniques were developed for constantly circulating ink to prevent an increase in the viscosity of the ink and reduce the occurrence of an image quality defect. Further, in an ink jet printer, when the pressure of the ink in the discharge head fluctuates, the amount of the ink to be discharged also fluctuates, and image quality deteriorates. Therefore, techniques were developed for generating negative pressure in the discharge head and keeping the negative pressure within an appropriate range. These problems might occur not only in an image forming apparatus but also in a fabricating apparatus such as a 3D printer that fabricates a three-dimensional image.

SUMMARY

In an aspect of the present disclosure, there is provided a liquid discharge device that includes a storage tank, a discharge head, a liquid feeder, a supply tank, a liquid path, a branch path, and a flow regulator. The storage tank is configured to store a liquid. The discharge head is configured to discharge the liquid. The liquid feeder is configured to feed the liquid from the storage tank to the discharge head in a liquid feed direction. The supply tank is disposed upstream of the discharge head in the liquid feed direction and configured to store the liquid fed by the liquid feeder while being in a state open to atmosphere. The liquid path is configured to flow the liquid from the liquid feeder to the supply tank. The branch path is connected to the liquid path and configured to cause part of the liquid to branch from the liquid path. The flow regulator is disposed downstream of the discharge head in the liquid feed direction and configured to control a flow rate of the liquid flowing into the discharge head.

In another aspect of the present disclosure, there is provided an image forming apparatus that includes the liquid discharge device.

In still another aspect of the present disclosure, there is provided a fabricating apparatus that includes the liquid discharge device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
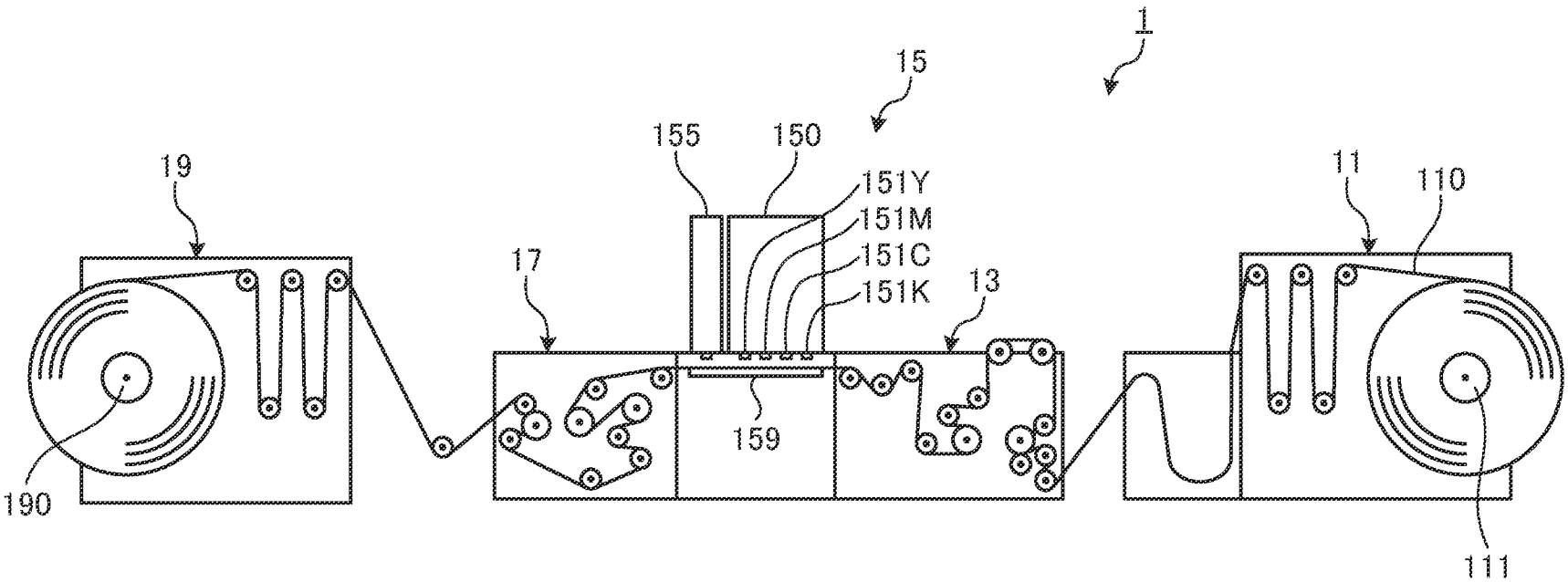
FIG. 1 is a diagram illustrating an example of a general arrangement of an image forming apparatus that includes a liquid discharge device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

The followings are descriptions of a liquid discharge device, an image forming apparatus, and a fabricating apparatus according to embodiments of the present disclosure, with reference to the drawings. The present invention is not limited by the embodiments described below, and the components in the embodiments include those which are obvious to a person skilled in the art, those which are substantially the same, and those which are in a so-called equivalent scope. Further, the components may be omitted, replaced, modified, and combined in various manners, without departing from the scope of the following embodiments.

Furthermore, in the embodiments described below, image formation, recording, printing, print, fabricating, and the like are all synonymous in terms of liquid discharge by a liquid discharge device.

General Arrangement of an Image Forming Apparatus

Figure 2:
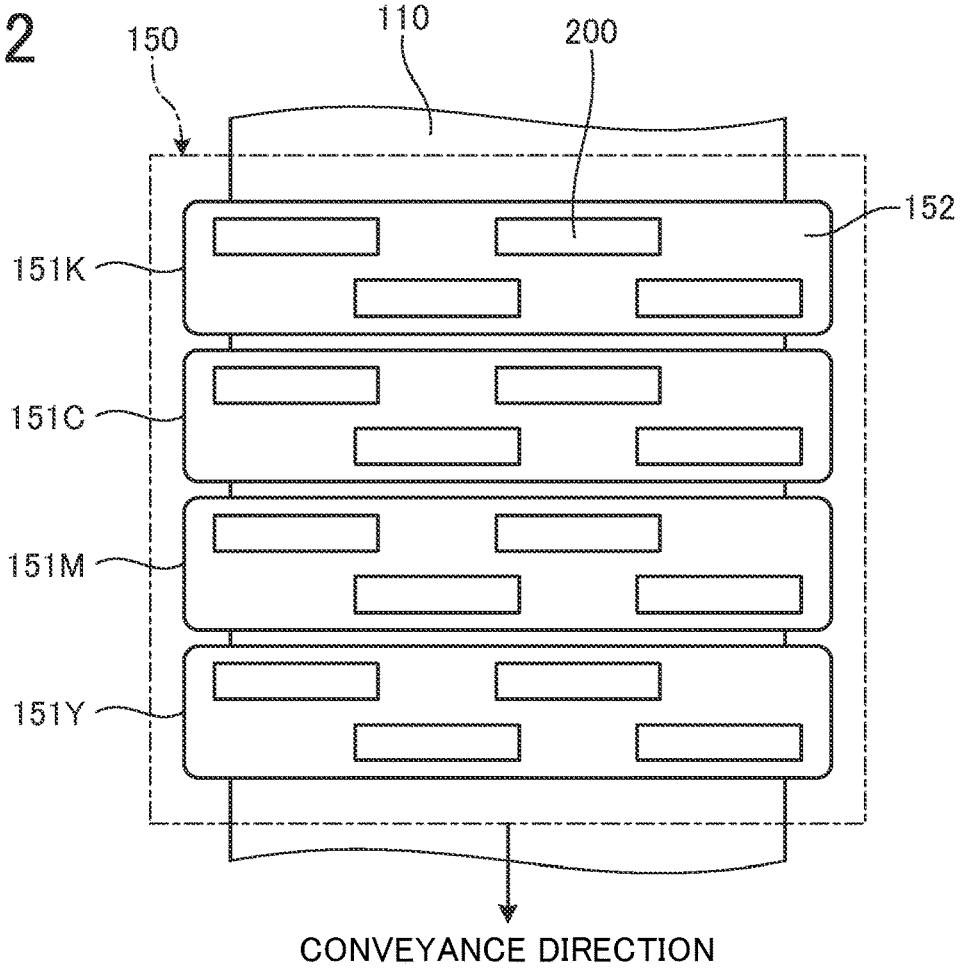
FIG. 2 is a schematic plan view of an example of the configuration of a head device of the image forming apparatus illustrated in FIG. 1.

FIG. 1 is a diagram illustrating an example of a general arrangement of an image forming apparatus that includes a liquid discharge device according to an embodiment of the present disclosure. FIG. 2 is a schematic plan view of an example of the configuration of a head device of the image forming apparatus according to the present embodiment. Referring to FIGS. 1 and 2, the general arrangement of an image forming apparatus 1 according to the present embodiment is described.

As illustrated in FIG. 1, the image forming apparatus 1 according to the present embodiment includes a feeder unit 11, a guiding conveyance unit 13, a printing unit 15, a drying unit 17, and a discharge unit 19.

The feeder unit 11 is a unit that feeds a recording medium 110 such as roll paper, and conveys the recording medium 110 to the guiding conveyance unit 13. The recording medium 110 is fed by rotation of a feed winding roller 111, guided and conveyed by the respective rollers of the feeder unit 11, the guiding conveyance unit 13, the printing unit 15, the drying unit 17, and the discharge unit 19, and is wound up by a wind-up roller 190 of the discharge unit 19.

The recording medium 110 is not necessarily paper, but may be a medium to which liquid can at least temporarily adhere, a medium to which liquid adheres and is fixed, a medium to and into which liquid adheres and penetrates, or the like. Specific examples of such media include recording media such as paper sheets, recording paper, recording sheets, film, and cloth, electronic boards, electronic components such as piezoelectric elements, powder layers (powdery layers), organ models, and test cells. The specific examples include all media to which liquid can adhere, unless otherwise specified.

The above material of a "medium to which liquid can adhere" should be a medium to which liquid can at least temporarily adhere, such as paper, thread, fiber, cloth, leather, metal, plastic, glass, wood, or ceramics.

The liquid is not limited to any particular liquid, as long as the liquid has such a viscosity or surface tension that the liquid can be discharged from a discharge head. However, the viscosity of the liquid is preferably not higher than 30 [mPa·sec] under ordinary temperature and ordinary pressure, or by heating or cooling. More specifically, the liquid may be a solution, a suspension, or an emulsion containing a solvent such as water or an organic solvent, a colorant such as a dye or a pigment, a functionalizing material such as a polymerizable compound, a resin, or a surfactant, a biocompatible material such as DNA, amino acid, protein, or calcium, an edible material such as a natural pigment, or the like. Any of these liquids can be used as an inkjet ink, a surface treatment liquid, a liquid for forming components or an electronic circuit resist pattern for electronic elements or light-emitting elements, a three-dimensional fabricating material solution, or the like.

The guiding conveyance unit 13 is a unit that guides and conveys the recording medium 110 conveyed by the feeder unit 11 to the printing unit 15.

The printing unit 15 is a unit that performs a printing process (image formation) on the recording medium 110 with a line-head discharge head. The printing unit 15 includes a head device 150, a head device 155, and a conveyance guide member 159.

The head device 150 is a unit that discharges four colors of ink (an example of the liquid) onto the recording medium 110, to print a full-color image on the recording medium 110. In the head device 150, a head array 151K that discharges K (black) ink, a head array 151C that discharges C (cyan) ink, a head array 151M that discharges M (magenta) ink, and a head array 151Y that discharges Y (yellow) ink are arranged in this order from the upstream side in the direction of conveyance of the recording medium 110. The head arrays 151C, 151M, 151Y, and 151K are simply referred to as the head array(s) 151 in a case where any desired head array is referred to or these head arrays are collectively referred to. Further, the colors and the number of colors of the ink to be discharged by the respective head arrays 151 are not limited to those described above.

Meanwhile, as illustrated in FIG. 2, the head device 150 is formed with discharge heads 200 disposed in a staggered arrangement with respect to the respective head arrays 151 on a base member 152, for example. The arrangement of the discharge heads 200 is not limited to the staggered arrangement, as long as the head device 150 can perform printing by a line head method.

The head device 155 is a unit that discharges a processing liquid onto the recording medium 110 on which the full-color image has been printed by the head device 150, to perform post-processing. For example, the head device 155 may apply a protector coating liquid as the processing liquid onto the printing surface of the full-color image on the recording medium 110, to protect the printing surface in the post-processing.

The conveyance guide member 159 is a guide member that conveys the recording medium 110 to the head device 150 and the head device 155 in such a manner that the recording medium 110 faces the head device 150 and the head device 155, so that the printing process by the head device 150 and the post-processing by the head device 155 are performed on the recording medium 110.

The printing unit 15 then conveys the recording medium 110, on which printing has been performed, to the drying unit 17.

The drying unit 17 is a unit that dries the moisture of the ink on the recording medium 110 on which an image is printed, and fixes the ink onto the paper sheet. After drying the recording medium 110, the drying unit 17 conveys the recording medium 110 to the discharge unit 19.

The discharge unit 19 is a unit that winds up the printed recording medium 110 conveyed from the drying unit 17, using the wind-up roller 190.

The unit configuration of the image forming apparatus 1 illustrated in FIG. 1 is an example, and the image forming apparatus 1 may have some other unit configuration. For example, as a step to be carried out after the drying unit 17, a cooling unit may be provided to cool the recording medium 110 that has become hot after the drying, and lower the temperature of the recording medium 110.

Although the printing unit 15 performs a printing process with a discharge head of a line-head type (a one-pass type), the printing unit 15 is not limited to the operation. Instead, a discharge head of a scanning type may perform a printing process while performing scanning in the main scanning direction with respect to the recording medium 110.

Configuration of Liquid Discharge Device According to Comparative Example

Figure 3:
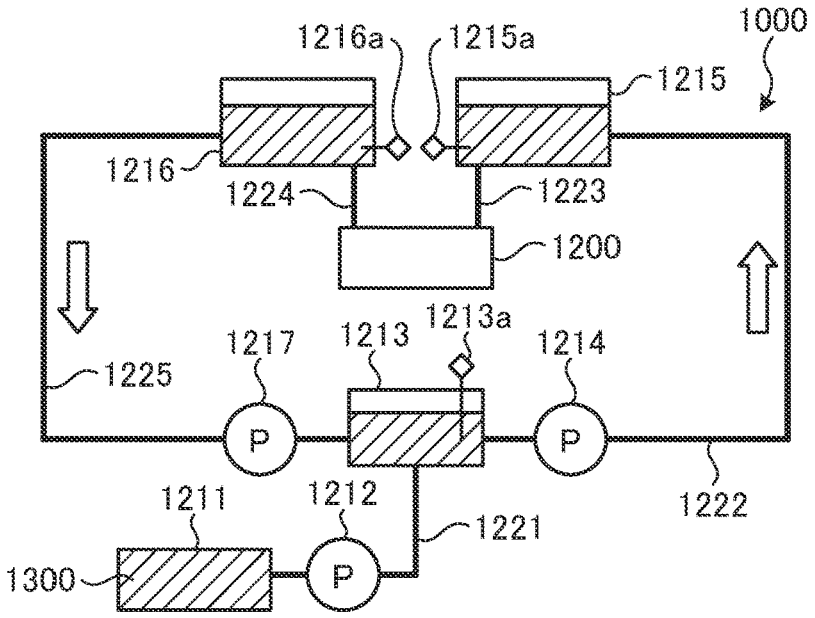
FIG. 3 is a diagram illustrating an example of the configuration of an ink circulation path of a liquid discharge device according to a comparative example of the present disclosure.

FIG. 3 is a diagram illustrating an example of the configuration of the ink circulation path of a liquid discharge device according to a comparative example of the present disclosure. Referring to FIG. 3, the configuration of the ink circulation path of the liquid discharge device according to the comparative example is described.

As illustrated in FIG. 3, a liquid discharge device 1000 according to the comparative example includes a circulation path that continuously circulates the ink to be discharged from the discharge head, to prevent an increase in the viscosity of the ink. Specifically, the liquid discharge device 1000 includes a main tank 1211, a supply feed pump 1212, a buffer tank 1213, a first liquid feed pump 1214, a first manifold tank 1215, a discharge head 1200, a second manifold tank 1216, and a second liquid feed pump 1217.

The main tank 1211 is a tank that stores a liquid 1300 that is the ink to be discharged from the discharge head 1200. The supply feed pump 1212 is disposed in a liquid path 1221 formed with a tube connecting the main tank 1211 and the buffer tank 1213. The supply feed pump 1212 is a pump that replenishes and supplies the buffer tank 1213 with ink from the main tank 1211, on the basis of a decrease in the amount of the ink in the buffer tank 1213 detected by a liquid level sensor 1213*a*.

The buffer tank 1213 is a tank that stores ink for the first liquid feed pump 1214 to supply to the first manifold tank 1215.

The first liquid feed pump 1214 is disposed in a liquid path 1222 formed with a tube connecting the buffer tank 1213 and the first manifold tank 1215. The first liquid feed pump 1214 is a pump that feeds ink from the buffer tank 1213 to the first manifold tank 1215, on the basis of a pressure detected by a first pressure sensor 1215*a* installed on the first manifold tank 1215 on the upstream side of the discharge head 1200. The first liquid feed pump 1214 is driven in accordance with an instruction from a control circuit, and the control circuit operates in accordance with a program being executed by a central processing unit (CPU).

The first manifold tank 1215 is a tank for storing ink so that the ink to be supplied to the discharge head 1200 will not run out during an ink discharge operation (a printing operation or a fabricating operation) at the discharge head 1200.

The discharge head 1200 includes a piezoelectric element, for example. When a drive signal is applied from a control circuit to the piezoelectric element, the discharge head 1200 causes contraction motion, and discharges ink in accordance with a change in the pressure caused by the contraction motion. By doing so, the discharge head 1200 prints an image onto a recording medium. The ink to be discharged from the discharge head 1200 is supplied from the first manifold tank 1215, and undischarged ink flows into the second manifold tank 1216, so that the ink circulates and is constantly supplied to the discharge head 1200. For ease of explanation, the first manifold tank 1215 and one discharge head 1200 are connected by a liquid path 1223 formed with a tube. However, in a case where there is a plurality of discharge heads 1200, manifolds for supplying ink to the respective discharge heads 1200 are disposed in the liquid path 1223.

The second manifold tank 1216 is a tank for storing ink so that the amount of ink in the circulation path will not run out during an ink discharge operation (a printing operation or a fabricating operation) at the discharge head 1200. For ease of explanation, one discharge head 1200 and the second manifold tank 1216 are connected by a liquid path 1224 formed with a tube. However, in a case where there is a plurality of discharge heads 1200, manifolds for gathering ink discharged from the respective discharge heads 1200 are disposed in the liquid path 1224.

The second liquid feed pump 1217 is disposed in a liquid path 1225 formed with a tube connecting the second manifold tank 1216 and the buffer tank 1213. The second liquid feed pump 1217 is a pump that feeds ink from the second manifold tank 1216 to the buffer tank 1213, on the basis of a pressure detected by a second pressure sensor 1216*a* installed on the second manifold tank 1216 on the downstream side of the discharge head 1200. The second liquid feed pump 1217 is driven in accordance with an instruction from a control circuit, and the control circuit operates in accordance with a program being executed by the CPU.

Next, an ink circulating operation in the above described liquid discharge device 1000 according to the comparative example is described. The liquid 1300 (ink) stored in the main tank 1211 is fed into the buffer tank 1213 by the supply feed pump 1212, on the basis of a result of detection performed by the liquid level sensor 1213*a* that detects the liquid level of the ink in the buffer tank 1213. Meanwhile, the ink in the first manifold tank 1215 is pressurized by the liquid fed by the first liquid feed pump 1214, and the ink in the second manifold tank 1216 is depressurized by the liquid fed by the second liquid feed pump 1217. As a result, a pressure difference is generated between the first manifold tank 1215 and the second liquid feed pump 1217. Due to this pressure difference, the ink constantly circulates in the circulation path, starting from the first manifold tank 1215 and returning to the buffer tank 1213 through the discharge head 1200 and the second manifold tank 1216. The ultimate purpose of such a circulation path is to maintain a constant ink pressure at the edge of the discharge head 1200. To achieve that purpose, the liquid discharge device 1000 operates to maintain a constant ink pressure in the first manifold tank 1215 (the pressure to be detected by the first pressure sensor 1215*a*) and a constant ink pressure in the second manifold tank 1216 (the pressure to be detected by the second pressure sensor 1216*a*).

The first manifold tank 1215 is pressurized to a target pressure by the first liquid feed pump 1214, on the basis of the pressure of the internally stored ink detected by the first pressure sensor 1215*a*. The first liquid feed pump 1214 feeds the liquid from the buffer tank 1213 to the first manifold tank 1215 when the pressure detected by the first pressure sensor 1215*a* becomes lower than a set threshold.

The second manifold tank 1216 is pressurized to a target pressure by the second liquid feed pump 1217, on the basis of the pressure of the internally stored ink detected by the second pressure sensor 1216*a*. The second liquid feed pump 1217 feeds the liquid from the second manifold tank 1216 to the buffer tank 1213 when the pressure detected by the second pressure sensor 1216*a* becomes lower than a set threshold.

As the ink flows from the first manifold tank 1215 into the second manifold tank 1216 through the discharge head 1200 due to the pressure difference described above, the pressure of the ink in the first manifold tank 1215 becomes lower. When the pressure of the ink in the first manifold tank 1215 detected by the first pressure sensor 1215*a* becomes lower, the first liquid feed pump 1214 replenishes the first manifold tank 1215 with ink from the buffer tank 1213, to pressurize the first manifold tank 1215.

Likewise, when the ink flows from the first manifold tank 1215 into the second manifold tank 1216 through the discharge head 1200 due to the pressure difference, the pressure of the second manifold tank 1216 becomes higher (or the negative pressure weakens). When the pressure of the ink in the second manifold tank 1216 detected by the second pressure sensor 1216*a* becomes higher, the second liquid feed pump 1217 discharges the ink into the buffer tank 1213, to depressurize the second manifold tank 1216.

In a case where the ink is not consumed by discharging or the like of the ink from the discharge head 1200 at this stage, the amount of the ink in the buffer tank 1213 does not significantly change. In a case where the ink is consumed by discharging or the like of the ink from the discharge head 1200, on the other hand, the amount of the ink in the buffer tank 1213 decreases. Therefore, the supply feed pump 1212 replenishes and supplies the buffer tank 1213 with the ink from the main tank 1211, on the basis of a decrease in the amount of ink detected by a liquid level sensor or the like.

If the pressure of the first manifold tank 1215 and the pressure of the second manifold tank 1216 are uniquely determined as described above, the flow rate of the ink flowing into the discharge head 1200 and the pressure at the edge of the discharge head 1200 are also uniquely determined by the value of the resistance (flow path resistance) of the liquid path in the discharge head 1200. As the negative pressure at the edge of the discharge head 1200 is maintained while the ink flow rate necessary for printing is secured in the discharge head 1200 as above, uniform print quality and uniform fabricating quality are maintained.

As described above, in the configuration of the liquid discharge device 1000 according to the comparative example, control is performed to maintain a constant flow rate for the ink flowing in the entire path. However, if external force is applied, the shapes of the tubes that form the paths changes, and disturbance such as a change in the flow path resistance occurs, resulting in a change in the ink flow rate. Due to the influence of that, the ink pressure at the edge of the discharge head 1200 changes. If this change is small enough, there is little influence on print quality and fabricating quality. However, if the change is large, the state of the ink at the edge of the discharge head 1200 changes, and the amount of the ink to be discharged from the discharge head 1200 also changes. Therefore, there is a possibility that print quality and fabricating quality will vary. Further, in a case where the change in the ink pressure is even larger, ink leakage, mixing with bubbles, or the like is caused, and there is a possibility that the ink cannot be discharged.

Therefore, to counter the problems with the liquid discharge device 1000 according to the comparative example described as above, the flow rate of the ink in the vicinity of the discharge head, instead of in the entire path in the liquid discharge device, is kept constant in the present embodiment. A liquid discharge apparatus according to the present embodiment enables reduction of the influence of disturbance generated in any liquid path other than the liquid paths in the vicinity of the discharge head, and includes a mechanism for maintaining a constant ink flow rate in the vicinity of the discharge, to quickly reduce pressure fluctuations due to the disturbance.

Configuration of Liquid Discharge Device According to Present Embodiment

Figure 4:
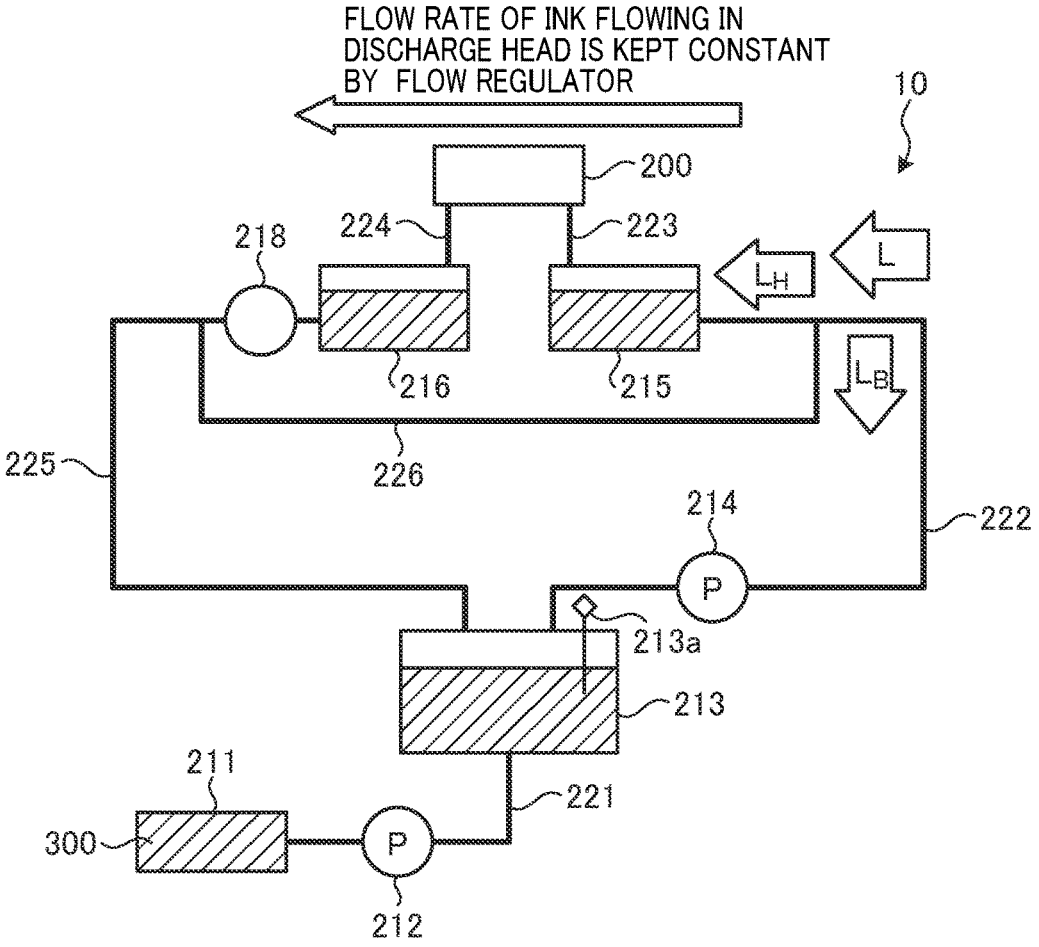
FIG. 4 is a diagram illustrating an example of the configuration of an ink circulation path of the liquid discharge device according to the embodiment illustrated in FIG. 1.

FIG. 4 is a diagram illustrating an example of the configuration of the ink circulation path of a liquid discharge device according to the present embodiment. Referring to FIG. 4, the configuration of the ink circulation path of a liquid discharge device 10 according to the present embodiment is described. The liquid discharge device 10 is disposed in the printing unit 15 illustrated in FIG. 1 described above.

As illustrated in FIG. 4, the liquid discharge device 10 according to the present embodiment includes a circulation path that continuously circulates the ink to be discharged from a discharge head, to prevent an increase in the viscosity of the ink. Specifically, the liquid discharge device 10 includes a main tank 211 (an example of a storage tank), a supply feed pump 212, a buffer tank 213 (an example of a storage tank), a liquid feed pump 214 (a first liquid feeder), a first manifold tank 215 (a supply tank), a discharge head 200, a second manifold tank 216, a flow regulator 218 (an example of a flow regulator), and a bypass path 226 (an example of a branch path).

The main tank 211 is a tank that stores a liquid 300 that is the ink to be discharged from the discharge head 200. The supply feed pump 212 is disposed in a liquid path 221 formed with a tube connecting the main tank 211 and the buffer tank 213. The supply feed pump 212 is a pump that replenishes and supplies the buffer tank 213 with ink from the main tank 211, on the basis of a decrease in the amount of the ink in the buffer tank 213 detected by a liquid level sensor 213*a*.

The buffer tank 213 is a tank that stores ink for the liquid feed pump 214 to supply to the first manifold tank 215.

The liquid feed pump 214 is disposed in a liquid path 222 formed with a tube connecting the buffer tank 213 and the first manifold tank 215. The liquid feed pump 214 is a pump that feeds the first manifold tank 215 with ink from the buffer tank 213. The liquid feed pump 214 is driven in accordance with an instruction from a pressure system controller 513 that is a control circuit described later, and the pressure system controller 513 operates in accordance with a program being executed by a CPU 501 described later.

The first manifold tank 215 is a tank for storing ink so that the ink to be supplied to the discharge head 200 will not run out during an ink discharge operation (a printing operation or a fabricating operation) at the discharge head 200.

The discharge head 200 includes a piezoelectric element, for example. When a drive signal is applied from a head drive controller 511 (described later) to the piezoelectric element, the discharge head 200 causes contraction motion, and discharges ink in accordance with a change in the pressure caused by the contraction motion. By doing so, the discharge head 200 prints an image onto a recording medium. The ink to be discharged from the discharge head 200 is supplied from the first manifold tank 215, and undischarged ink flows into the second manifold tank 216, so that the ink circulates and is constantly supplied to the discharge head 200. For ease of explanation, the first manifold tank 215 and the discharge head 200 are connected by a liquid path 223 formed with a tube. However, in a case where there is a plurality of discharge heads 200, manifolds for supplying ink to the respective discharge heads 200 are disposed in the liquid path 223.

In the discharge head 200, a piezoelectric actuator that discharges ink is formed with a piezoelectric element, and either a stacked piezoelectric element or a thin-film piezoelectric element may be used. However, it is not necessary to use a piezoelectric actuator, and it is possible to use a thermal actuator formed with an electrothermal transducer such as a heating resistor, or an electrostatic actuator including a diaphragm and a counter electrode, for example.

The second manifold tank 216 is a tank for storing ink so that the amount of ink in the circulation path will not run out during an ink discharge operation (a printing operation or a fabricating operation) at the discharge head 200. For ease of explanation, one discharge head 200 and the second manifold tank 216 are connected by a liquid path 224 formed with a tube. However, in a case where there is a plurality of discharge heads 200, manifolds for gathering ink discharged from the respective discharge heads 200 are disposed in the liquid path 224.

The flow regulator 218 is disposed in a liquid path 225 formed with a tube connecting the second manifold tank 216 and the buffer tank 213. The flow regulator 218 is a device that maintains a constant amount of ink to be discharged from the second manifold tank 216, which is a constant amount of ink flowing into the discharge head 200. The specific structure of the flow regulator 218 will be described later with reference to FIG. 7.

The bypass path 226 is a liquid path that connects (links) the upstream side of the first manifold tank 215 in the liquid path 222 to the downstream side of the flow regulator 218 in the liquid path 225, and causes part of the ink flowing into the first manifold tank 215 to bypass the first manifold tank 215 (or to branch) to flow toward the downstream side of the flow regulator 218.

The ultimate purpose of the circulation path of the liquid discharge device 10 as above is to maintain a constant ink pressure at the edge of the discharge head 200, as in the above described liquid discharge device 1000 according to the comparative example. A configuration that maintains a constant flow rate for the ink flowing into the discharge head 200 in the liquid discharge device 10 to achieve the purpose is first described. To maintain a constant flow rate for the ink flowing into the discharge head 200, the liquid discharge device 10 according to the present embodiment has three aspects that differ from the configuration of the above-described liquid discharge device 1000 according to the comparative example.

The first different aspect is that the liquid discharge device 10 includes one pump (the liquid feed pump 214) that feeds ink, while the liquid discharge device 1000 according to the comparative example includes two pumps (the first liquid feed pump 1214 and the second liquid feed pump 1217) that feed ink. The second different aspect is that the liquid discharge device 10 includes the bypass path 226 that links the liquid path on the upstream side of the discharge head 200 to the liquid path on the downstream side not through the discharge head 200. Specifically, as described above, the bypass path 226 links the upstream side of the first manifold tank 215 in the liquid path 222 to the downstream side of the flow regulator 218 in the liquid path 225. The third different aspect is that, in the liquid discharge device 10, the flow regulator 218 is disposed between the discharge head 200 and the junction of the bypass path 226 and the liquid path on the downstream side of the discharge head 200. Specifically, the flow regulator 218 is disposed between the second manifold tank 216 and the junction of the bypass path 226 with the liquid path 225. Having a configuration including the above three different aspects, the liquid discharge device 10 according to the present embodiment can maintain a constant flow rate for the ink flowing into the discharge head 200. An ink circulating operation in this liquid discharge device 10 is now described.

The liquid feed pump 214 is a pump that feeds ink from the buffer tank 213 to the first manifold tank 215. Here, part of the ink with a flow rate L supplied from the liquid feed pump 214 flows into the first manifold tank 215 at a flow rate $L_H$, and the remaining part flows into the bypass path 226 at a flow rate $L_B$.

As described above, part of the ink with the flow rate L supplied from the liquid feed pump 214 flows toward the first manifold tank 215 and flows in the discharge head 200. In a case where the flow rate of the ink in the discharge head 200 becomes lower, the ink flowing into the bypass path 226 is pulled toward the first manifold tank 215 by ink flow control performed by the flow regulator 218. As a result, it is possible to control the flow rate of the ink in the discharge head 200 to be a constant flow rate, without changing the output of the liquid feed pump 214.

In a case where the flow rate of the ink in the discharge head 200 becomes higher, on the other hand, the unnecessary part of the ink flowing into the discharge head 200 is made to flow into the bypass path 226 by ink flow control performed by the flow regulator 218. As a result, it is possible to control the flow rate of the ink in the discharge head 200 to be a constant flow rate, without changing the output of the liquid feed pump 214.

Further, in a case where the ink is not consumed by discharging or the like of the ink from the discharge head 200, the amount of the ink in the buffer tank 213 does not significantly change. In a case where the ink is consumed by discharging or the like of the ink from the discharge head 200, on the other hand, the amount of the ink in the buffer tank 213 decreases. Therefore, the supply feed pump 212 replenishes and supplies the buffer tank 213 with the ink from the main tank 211, on the basis of a decrease in the amount of the ink detected by the liquid level sensor 213*a* in the buffer tank 213.

The liquid discharge device 10 is not necessarily an apparatus that discharges ink to visualize meaningful images of characters, figures, or the like. For example, a liquid discharge device may form meaningless images, such as meaningless patterns, or form three-dimensional images.

Alternatively, the liquid discharge device 10 may be a processing liquid application apparatus that discharges a processing liquid onto a paper sheet to apply the processing liquid onto the surface of the paper sheet and modify the surface of the paper sheet, or an injecting granulation apparatus that sprays a composition liquid containing a raw material dispersed in a solution through a nozzle to granulate fine particles of the raw material, or the like.

Next, specific advantages of the liquid discharge device 10 according to the present embodiment over the liquid discharge device 1000 according to the comparative example are described. When external stress is applied to the circulation path, the shapes of the tubes constituting the path change. As a result, the flow rate of the ink in the portions with the changed shapes changes, and this change in the flow rate causes the pressure at the edge of the discharge head to fluctuate. To counter such a pressure fluctuation, the liquid discharge device 1000 according to the comparative example detects the pressure fluctuation with the first pressure sensor 1215*a* and the second pressure sensor 1216*a*, and then changes the outputs of the first liquid feed pump 1214 and the second liquid feed pump 1217. As a result, the pressure fluctuation can be reduced, and the pressure at the edge of the discharge head 1200 becomes constant. However, the farther the pumps (the first liquid feed pump 1214 and the second liquid feed pump 1217) are from the discharge head 1200, the longer it takes for the flow rate of the ink flowing into the discharge head 1200 to change. Accordingly, the time required to reduce the pressure fluctuation becomes also longer. Here, by a technique for quickly reducing the pressure fluctuation at the edge of the discharge head 1200, it is possible to shorten the path between a pump (the first liquid feed pump 1214 or the second liquid feed pump 1217) and the discharge head 1200. However, there is a limit to shortening the path between a pump and the discharge head 1200, because vibration of the pump is transmitted to the discharge head 1200 to cause the pressure fluctuation.

In the liquid discharge device 10 according to the present embodiment, on the other hand, in a case where the flow rate of the ink in the discharge head 200 becomes lower, the ink flowing into the bypass path 226 is pulled toward the first manifold tank 215 by ink flow control performed by the flow regulator 218. In a case where the flow rate of the ink in the discharge head 200 becomes higher, on the other hand, the unnecessary part of the ink flowing into the discharge head 200 is made to flow into the bypass path 226 by ink flow control performed by the flow regulator 218. As a result, in the liquid discharge device 10 according to the present embodiment, it is possible to control the flow rate of the ink in the discharge head 200 to be a constant flow rate, without changing the output of the liquid feed pump 214. Further, in the liquid discharge device 10 according to the present embodiment, the flow regulator 218 is disposed instead of one of the two pumps of the liquid discharge device 1000 according to the comparative example, but the flow regulator 218 is smaller in size than the pump. Accordingly, the size of the entire liquid discharge device 10, or the size of the entire printing unit 15, can be made smaller. Furthermore, unlike the pump, the flow regulator 218 does not generate vibration, so that the distance to the discharge head 200 can be shortened. As a result, the flow rate of the ink flowing into the discharge head 200 is quickly changed with an ink pressure fluctuation at the edge of the discharge head 200, so that the flow rate can be made constant.

In the liquid discharge device 10 according to the present embodiment, to cause unnecessary ink to flow into the bypass path 226 and maintain a constant flow rate for the ink flowing into the discharge head 200, it is necessary to set an appropriate flow path resistance for the bypass path 226, as described above. This is because, in a case where the flow path resistance of the bypass path 226 is considerably lower than the flow path resistance of the path leading to the discharge head 200 in which the ink flow rate is to be controlled, most of the ink supplied from the liquid feed pump 214 flows into the bypass path 226, for example. A method for appropriately setting a flow path resistance for the bypass path 226 is described below in detail.

The flow rate system of liquid can be considered equivalent to the behavior of current in an electric circuit, because of the similarity of behaviors. In that case, voltage corresponds to pressure, current corresponds to flow velocity, and flow path resistance corresponds to electric resistance. Here, the flow rate of the ink supplied from the liquid feed pump 214 is represented by L, the flow rate of the ink flowing toward the discharge head 200 is represented by $L_H$, and the flow rate of the ink flowing into the bypass path 226 is represented by $L_B$, as described above. Further, the flow path resistance of the path including the discharge head 200 to be bypassed by the bypass path 226 is represented by $R_H$, and the flow path resistance of the bypass path 226 is represented by $R_B$. When the Kirchhoff's law in an electric circuit is applied in this case, the sum of the ink flow rates is constant, and accordingly, the following Equation (1) is established.

[Equation 1]

$$=L_H+L_B \tag{1}$$

Further, the ratio between the flow rate $L_B$ of the ink flowing in the bypass path 226 and the flow rate $L_H$ of the ink flowing in the path including the discharge head 200 is determined from the flow path resistance, the following Equation (2) is established.

[Equation 2]

$$L_B = \frac{R_H}{R_B} L_H \tag{2}$$

From the above Equations (1) and (2), the flow path resistance $R_B$ of the bypass path 226 is calculated according to the following Equation (3).

[Equation 3]

$$R_B = \frac{L_H}{L - L_H} R_H \tag{3}$$

In other words, the flow path resistance $R_B$ of the bypass path 226 is uniquely determined from the three values: the flow rate L of the ink supplied from the liquid feed pump 214, the flow path resistance $R_H$ of the path including the discharge head 200, and the flow rate $L_H$ of the ink flowing into the discharge head 200. Here, a tube having a diameter of 6 mm is assumed to be the material used as the bypass path 226. Where the length of the tube is represented by 1 [mm], the diameter of the tube is represented by d [mm], and the viscosity of the flowing ink is represented by μ [Pa·sec], the flow path resistance R of this tube is calculated according to the following Equation (4).

[Equation 4]

$$R = \frac{128 \times \mu \times \ell}{\pi \times d^4} \tag{4}$$

In a steady state, when a third of the flow rate of the ink supplied from the liquid feed pump 214 is to be supplied to the discharge head 200, and the remaining two thirds are to be supplied to the bypass path 226, the flow path resistance of the bypass path 226 needs to be half the flow path resistance $R_H$ of the path including the discharge head 200. In a case where the viscosity μ of the flowing ink is $8\times10^{-3}$ [Pa·sec] (8 [mPa·sec]), and the flow path resistance $R_H$ of the path including the discharge head 200 is 1600 [Pa/sec·ml], to obtain the bypass path 226 having the target flow path resistance, it is necessary to prepare a tube having a diameter of 6 mm and a length of 3.2 m.

With the bypass path 226 having a flow path resistance calculated by the setting method as described above, the ink flow rate component that has changed due to disturbance in the middle of the liquid path is absorbed by the flow rate of the ink flowing into the bypass path 226. For this reason, even if the flow rate of the ink flowing into the discharge head 200 changes, control can be performed so that the ink flow rate quickly becomes constant.

Figure 5:
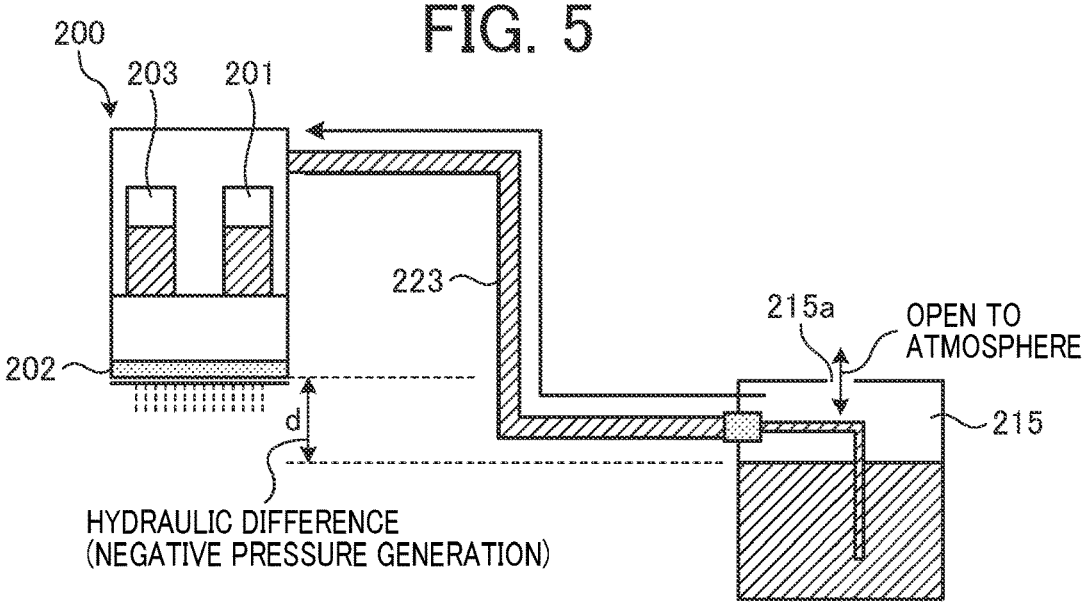
FIG. 5 is a diagram of a configuration for generating negative pressure in the liquid discharge device according to the embodiment illustrated in FIG. 1.

Next, a configuration for maintaining a constant ink pressure at the edge of the discharge head 200 in the liquid discharge device 10 is described with reference to FIG. 5. FIG. 5 is a diagram for explaining a configuration for generating negative pressure in the liquid discharge device according to the present embodiment.

The pressure of the ink at the edge of the discharge head 200 is determined by the two values: the product of the flow rate $L_H$ of the ink flowing into the discharge head 200 and the flow path resistance $R_H$ of the path including the discharge head 200 ($L_H \times R_H$); and the hydraulic head difference between the edge of the discharge head 200 and a site open to the atmosphere. As described above, the flow rate of the ink flowing into the discharge head 200 is controlled to be constant. Further, the flow path resistance of the path including the discharge head 200, which is more particularly the path between the discharge head 200 and the first manifold tank 215 on the upstream side of the discharge head 200, is uniquely determined by the path shape. Therefore, the product of the flow rate of the ink flowing into the discharge head 200 and the flow path resistance of the path including the discharge head 200 is constant. Accordingly, the pressure of the ink at the edge of the discharge head 200 is determined by the hydraulic head difference from the site open to the atmosphere.

In view of the above, in the liquid discharge device 10 according to the present embodiment, the first manifold tank 215 on the upstream side of the discharge head 200 in a direction in which the liquid feed pump 214 feeds ink from the buffer tank 213 to the discharge head 200 is opened to the atmosphere, and the discharge head 200 is disposed at a higher position (a higher side in the direction in which the gravity force acts) than the first manifold tank 215, as illustrated in FIG. 5. Negative pressure is generated from the hydraulic head difference caused in this arrangement. The configuration of the liquid discharge device 10 for generating this negative pressure is specifically described.

As illustrated in FIG. 5, the discharge head 200 is connected to the first manifold tank 215 by the liquid path 223, and is disposed at a position higher than the first manifold tank 215. The discharge head 200 includes a supply-side liquid chamber 201, a nozzle plate 202, and a discharge-side liquid chamber 203. The ink supplied from the first manifold tank 215 to the discharge head 200 is sent from the supply-side liquid chamber 201 of the discharge head 200 to nozzles formed on the nozzle plate 202. On the nozzle plate 202, a nozzle array formed with a plurality of nozzles is disposed in a direction perpendicular to the conveyance direction. The ink not discharged from the nozzles formed so that the discharge direction is a downward direction flows to the discharge-side liquid chamber 203, and then flows to the second manifold tank 216 through the liquid path 224.

In the first manifold tank 215, an air release port 215*a* is formed to expose the ink stored inside to the atmosphere. Because of the air release, the pressure of the ink in the first manifold tank 215 becomes constant. Further, since the discharge head 200 is disposed at a higher position than the first manifold tank 215 as described above, a hydraulic head difference d is formed between the discharge surface of the ink to be discharged from the nozzles of the discharge head 200 and the surface of the ink in the first manifold tank 215. Because of this hydraulic head difference d, negative pressure is generated in the ink at the edge of the discharge head 200.

As described above, the negative pressure is generated from the hydraulic head difference formed in the arrangement in which the first manifold tank 215 on the upstream side of the discharge head 200 is made open to the atmosphere, and the discharge head 200 is disposed at a higher position than the first manifold tank 215. Accordingly, the flow rate of the ink flowing into the discharge head 200, the flow path resistance of the path including the discharge head 200, and the pressure of the ink in the first manifold tank 215 become constant. Thus, the pressure of the ink at the edge of the discharge head 200 is also uniquely determined. The position of the first manifold tank 215 on the upstream side of the discharge head 200 is then determined from the pressure determined by the flow rate of the ink flowing into the discharge head 200 and the flow path resistance of the path including the discharge head 200. Thus, the negative pressure of the ink at the edge of the discharge head 200 can be maintained at a desired value.

The importance of opening the first manifold tank 215 on the upstream side of the discharge head 200 to the atmosphere is now described in greater detail.

In the liquid discharge device 1000 according to the comparative example, the buffer tank 1213 is often opened to the atmosphere, to control the pressure of the ink at the edge of the discharge head. This is because the liquid discharge device 1000 according to the comparative example controls the flow rate of the entire path to be constant. In the liquid discharge device 10 according to the present embodiment, however, if the buffer tank 213 is opened to the atmosphere, there is a possibility that pressure control cannot be appropriately performed on the ink at the edge of the discharge head 200. This is because the control performed by the liquid discharge device 10 to maintain a constant flow rate for the ink flowing into the discharge head 200 causes a fluctuation in the flow rate in the bypass path 226 and the like other than the vicinity of the discharge head 200. If the flow rate of the ink flowing into the bypass path 226 fluctuates, the pressure indicated by the product of the flow path resistance of the bypass path 226 and the flow rate also fluctuates, and the pressure of the ink at the edge of the discharge head 200 cannot be kept constant. Therefore, in the liquid discharge device 10 according to the present embodiment, it is necessary to open the vicinity of the discharge head 200 whose ink flow rate is kept constant, or the upstream first manifold tank 215 on the upstream side, to the atmosphere.

Although the air release port 215*a* is formed to open the first manifold tank 215 to the atmosphere, the present invention is not limited to such a configuration. For example, the first manifold tank 215 may be formed with a flexible member. As the first manifold tank 215 is formed with a flexible member, the volume of the first manifold tank 215 varies with change in the atmospheric pressure. As a result, the pressure of the ink in the first manifold tank 215 can be set at the atmospheric pressure, while the occurrence of bubble mixing due to the ink being exposed directly to the atmosphere is prevented. In other words, the configuration for opening the first manifold tank 215 to the atmosphere is not necessarily limited to a configuration for exposing the internal ink directly to the atmosphere, but may be a configuration for making the pressure of the internal ink substantially equal to the atmospheric pressure as described above.

Hardware Configuration of Printing Unit

Figure 6:
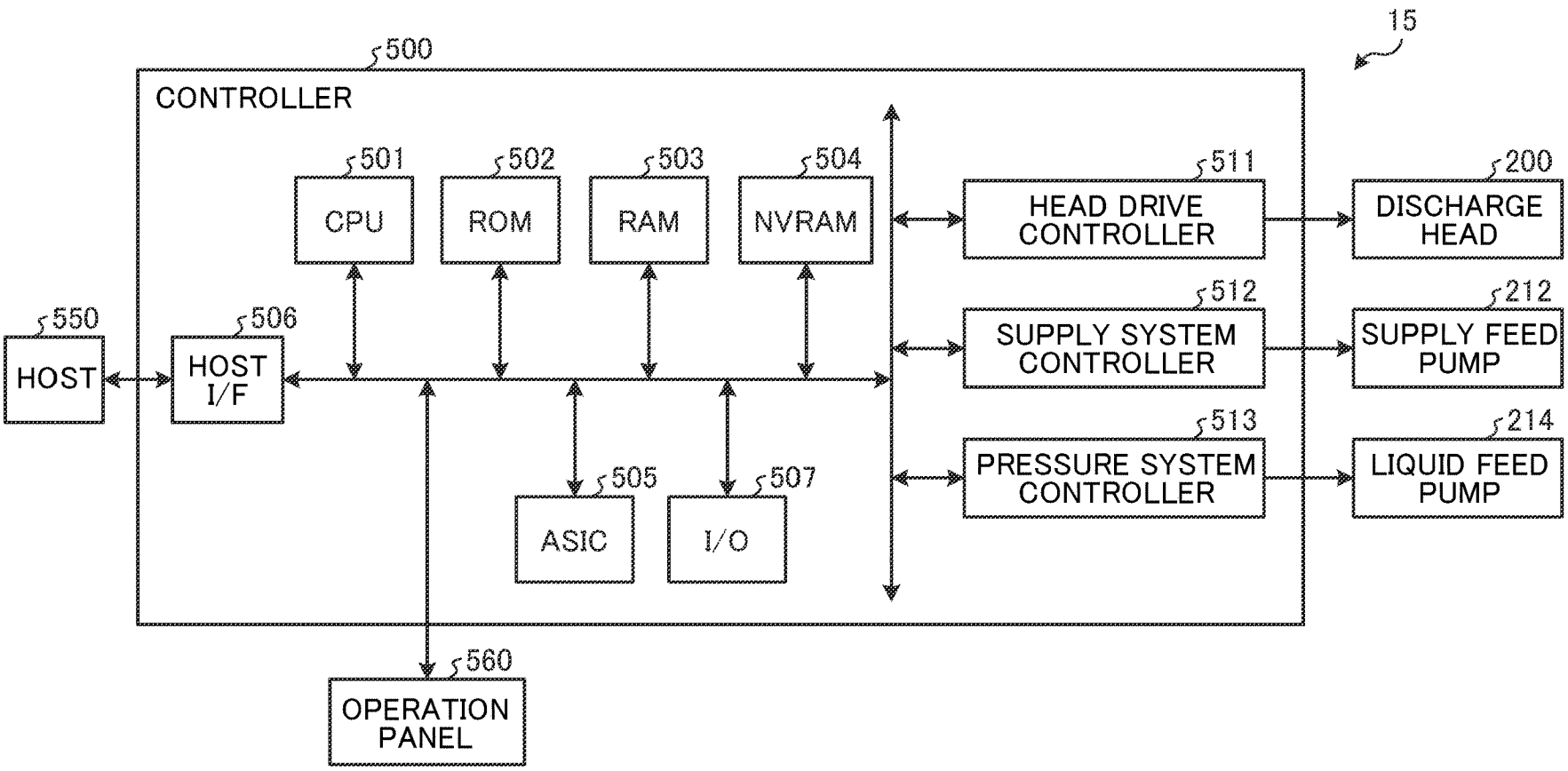
FIG. 6 is a diagram illustrating an example hardware configuration of the control system of a head device of the image forming apparatus according to the embodiment illustrated in FIG. 1.

FIG. 6 is a diagram illustrating an example hardware configuration of the control system of the head device of the image forming apparatus according to the present embodiment. Referring to FIG. 6, the hardware configuration of the printing unit 15 of the image forming apparatus 1 according to the present embodiment is described.

As illustrated in FIG. 6, the printing unit 15 of the image forming apparatus 1 according to the present embodiment includes a controller 500, the discharge head 200, the supply feed pump 212, the liquid feed pump 214, and an operation panel 560.

The controller 500 is a device that controls operation of the entire printing unit 15. As illustrated in FIG. 6, the controller 500 includes the CPU 501, a read only memory (ROM) 502, a random access memory (RAM) 503, and a nonvolatile RAM (NVRAM) 504. The controller 500 further includes an application specific integrated circuit (ASIC) 505, a host interface (I/F) 506, an input/output (I/O) 507, a head drive controller 511, a supply system controller 512, and the pressure system controller 513.

The CPU 501 is an arithmetic device that controls operation of the entire printing unit 15. The ROM 502 is a nonvolatile memory that stores the program to be executed by the CPU 501 and other fixed data. The RAM 503 is a volatile memory that functions as a work area of the CPU 501. The NVRAM 504 is a nonvolatile memory that stores data even while the power supply to the printing unit 15 is shut off.

The ASIC 505 is an integrated circuit that performs various kinds of signal processing for image data or print data, and image processing such as rearrangement, or processes input/output signals for controlling the entire printing unit 15.

The host I/F 506 is an interface that exchanges data and signals with a host 550. The host I/F 506 may be a network interface compliant with Transmission Control Protocol (TCP)/Internet Protocol (IP), for example. Alternatively, the host I/F 506 may be a universal serial bus (USB), or an interface for 2-wire bus communication or the like. The host 550 connected to the host I/F 506 may be an information processing apparatus such as a personal computer (PC), an image reading device such as an image scanner, an imaging apparatus such as a digital camera, or some other unit disposed adjacent to the printing unit 15, for example.

The I/O 507 is an interface that inputs detection signals from various kinds of sensors disposed in the printing unit 15.

The head drive controller 511 is a control circuit that controls the driving of the discharge head 200. The head drive controller 511 transfers image data as serial data to a drive circuit in the discharge head 200. In doing so, the head drive controller 511 generates the transfer clock and the latch signal necessary for transferring the image data and confirming the transfer, and the drive waveform to be used when the discharge head 200 discharges ink, and outputs the transfer clock, the latch signal, and the drive waveform to the drive circuit in the discharge head 200. The drive circuit in the discharge head 200 selectively inputs the drive waveform corresponding to the input image data, to the piezoelectric element of each nozzle of the discharge head 200.

The supply system controller 512 is a control circuit that controls the driving of the supply feed pump 212, under the control of the CPU 501. The pressure system controller 513 is a control circuit that controls the driving of the liquid feed pump 214, under the control of the CPU 501.

The operation panel 560 is a device that has an input function and a display function to receive various kinds of inputs in accordance with user operations, and display various kinds of information (for example, information corresponding to received operations, information indicating the operation statuses of the printing unit 15 and the image forming apparatus 1, a setting screen, and the like). The operation panel 560 is formed with a liquid crystal display (LCD) having a touch panel function, for example. The operation panel 560 is not necessarily a liquid crystal display, and may be formed with an organic electro-luminescence (EL) display having a touch panel function, for example. The operation panel 560 may have an operation unit such as hardware keys, or a display unit such as a lamp, in addition to or instead of the touch panel function.

The outline of operation in the printing unit 15 having the above configuration is now described. Through the host I/F 506, the controller 500 receives print data and the like from the host 550 via a cable or a network. The CPU 501 then reads and analyzes the print data in a reception buffer included in the host I/F 506. The ASIC 505 then performs necessary image processing, data rearrangement, and the like, and transfers the processed data (image data) to the discharge head 200 through the head drive controller 511. Generation of dot pattern data for outputting an image may be performed by storing font data into the ROM 502, for example. A printer driver on the side of the host 550 may develop the image data into bitmap data, and transfer the bitmap data to the printing unit 15.

Note that the hardware configuration of the printing unit 15 illustrated in FIG. 6 is merely an example, and the printing unit 15 do not necessarily include all the components illustrated in FIG. 6, or may include some other components.

Example Structure of Flow Regulator

Figure 7:
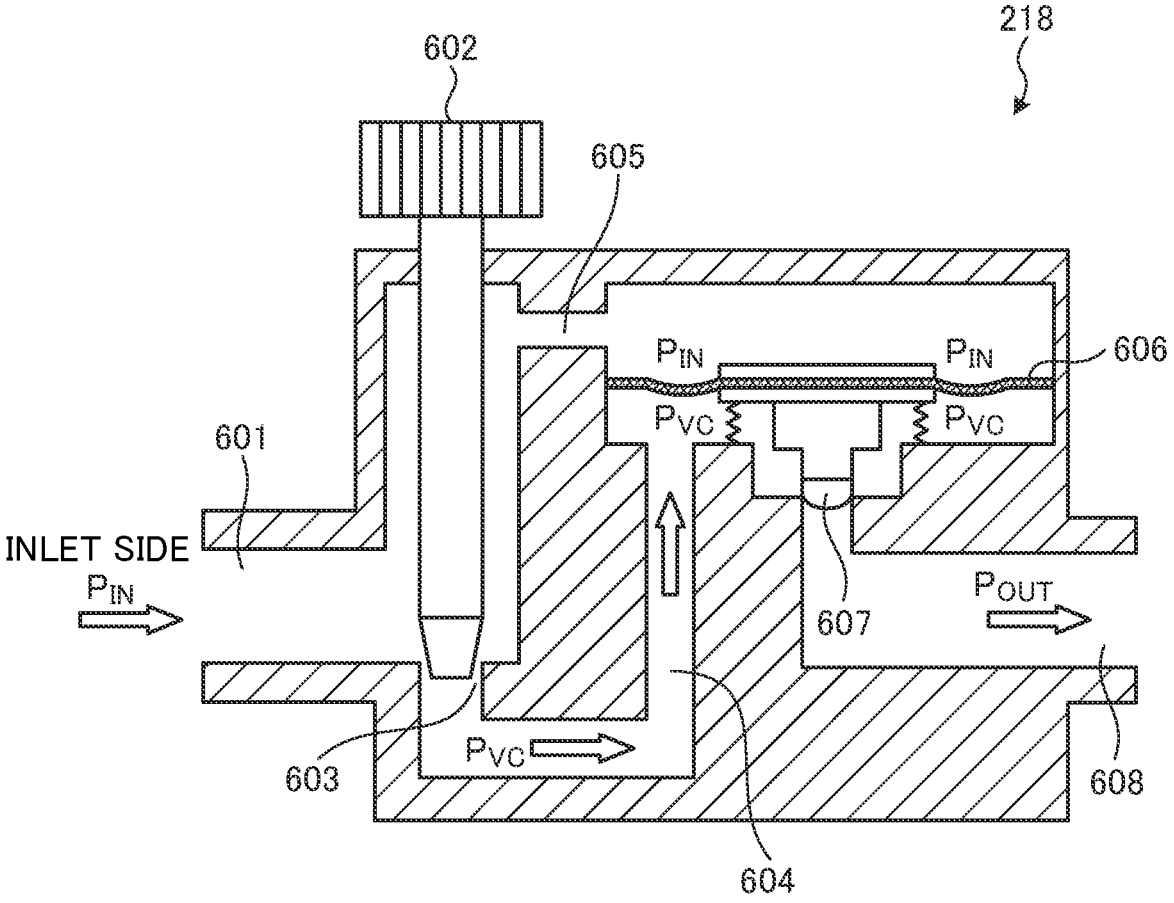
FIG. 7 is a diagram illustrating an example structure of a flow regulator in the liquid discharge device according to the embodiment illustrated in FIG. 1.

FIG. 7 is a diagram illustrating an example structure of the flow regulator in the liquid discharge device according to the present embodiment. A general constant flow valve can be used as the flow regulator 218 described above. Here, a constant flow valve has a mechanism that varies the internal flow path resistance so that a preset flow rate is achieved by an internal valve and a spring mechanism even in a case where the pressures on the upstream and downstream sides fluctuate. This constant flow valve is connected in series to a liquid path, so that the flow rate of the ink flowing in the liquid path can be made constant. Referring now to FIG. 7, an example of a specific structure of the flow regulator 218, which is a constant flow valve, is described.

As illustrated in FIG. 7, the flow regulator 218 includes a setting valve 602, a diaphragm 606, and a flow control valve 607. Part of the ink that has flowed in from an inlet hole 601 of the flow regulator 218 flows to a liquid chamber above the diaphragm 606 joined to the flow control valve 607 via a pressure introduction channel 605. In a case where the pressure of the ink flowing in from the inlet hole 601 is represented by $P_{IN}$, the pressure of the ink flowing into the liquid chamber above the diaphragm 606 is also $P_{IN}$.

Meanwhile, the remaining portion of the ink that has flowed in from the inlet hole 601 increases the flow velocity after passing through a contraction flow portion 603 between the setting valve 602 whose position has been adjusted in advance and the inner wall, and further flows into a liquid chamber under the diaphragm 606 through a flow path 604. The pressure of the ink having passed through the contraction flow portion 603 is a pressure $P_{VC}$ lower than the pressure $P_{IN}$ due to pressure loss accompanying the contraction flow.

Because of the above behavior of the ink, the pressure of the ink above the diaphragm 606 is $P_{IN}$, and the pressure of the ink under the diaphragm 606 is $P_{VC}$, generating a differential pressure $P_{IN}-P_{VC}$. The differential pressure $P_{IN}-P_{VC}$ generates a force acting in a vertical direction with respect to the diaphragm 606. Due to the generation of a force acting on the diaphragm 606, the flow control valve 607 moves up and down, and the ink under the diaphragm 606 flows out from an outlet hole 608 via the space between the flow control valve 607 and the inner wall. Here, the pressure of the ink flowing out from the outlet hole 608 is represented by $P_{OUT}$.

In the flow regulator 218 having the above structure, when the pressure $P_{IN}$ of the ink flowing in from the inlet hole 601 becomes higher, the differential pressure $P_{IN}-P_{VC}$ acting on the diaphragm 606 becomes higher, for example. When the differential pressure $P_{IN}-P_{VC}$ becomes higher, the diaphragm 606 generates a downward force, and operates in the direction to close the flow control valve 607. Thus, the flow rate of the ink passing through the flow regulator 218 is controlled to be constant.

Operation in a case where this flow regulator 218 is used in the liquid discharge device 10 illustrated in FIG. 4 as described above is now described. When a discharge operation is performed by the discharge head 200, the flow rate of the ink flowing in the flow regulator 218 becomes lower. As the flow rate of the ink becomes lower, the pressure of the ink also becomes lower. As a result, the pressure $P_{IN}$ of the ink at the inlet hole 601 of the flow regulator 218 also becomes lower. As the pressure $P_{IN}$ becomes lower, the differential pressure $P_{IN}-P_{VC}$ acting on the diaphragm 606 also becomes lower, and the downward force acting on the diaphragm 606 also becomes smaller, to open the flow control valve 607, and make the flow path resistance of the flow regulator 218 lower than before the ink discharge from the discharge head 200. As a result, the ratio between the flow path resistance of the bypass path 226 and the flow path resistance of the flow regulator 218 changes, and the ink flowing into the bypass path 226 is pulled toward and flows into the flow regulator 218. The flow path resistance of the flow regulator 218 then changes so that the flow rate becomes the same as that before the ink discharge from the discharge head 200. In this manner, even if a discharge operation is performed by the discharge head 200, the flow regulator 218 performs control so that the flow rate of the ink flowing into the discharge head 200 becomes constant.

In the liquid discharge device 10 according to the present embodiment, the flow regulator 218 as described above is adopted, and one pump (the liquid feed pump 214) is used, so that an ink circulation mechanism is obtained. The liquid discharge device 1000 according to the comparative example uses two pumps, but a program to be executed by the CPU needs to be developed to control these pumps. In the liquid discharge device 10 according to the present embodiment, however, control according to a program is unnecessary, and the flow rate of ink is controlled by the flow regulator 218 that operates without receiving any instruction from outside. Accordingly, the number of development steps can be reduced, and an increase in cost can be prevented.

Furthermore, the flow regulator 218 described above is simple in structure, low in cost, and smaller than a pump. Accordingly, the printing unit 15 can be made smaller in size. Thus, the degree of freedom in layout can be made higher, and the restrictions on the layout can be reduced. Further, the costs of the printing unit 15 and the entire image forming apparatus 1 can be lowered.

The flow regulator for maintaining a constant flow rate for the ink flowing into the discharge head 200 is not necessarily limited to the flow regulator 218. For example, a mechanism that uses a throttle valve (a flow control valve), a flow sensor (a second detector) that detects the flow rate of the ink flowing into the discharge head 200, and a control mechanism that controls the opening of the throttle valve on the basis of the output value of the flow sensor may be used as the flow regulator. Although such a flow regulator is disadvantageous in terms of the costs and the number of steps in development, compared with the flow regulator 218 described above. However, it is possible to obtain a flow regulator that has a high degree of freedom and is capable of more minute flow control, by creating a new technique for developing a control mechanism.

Effects on Responsiveness of Pressure at Edge of Discharge Head

Figure 8:
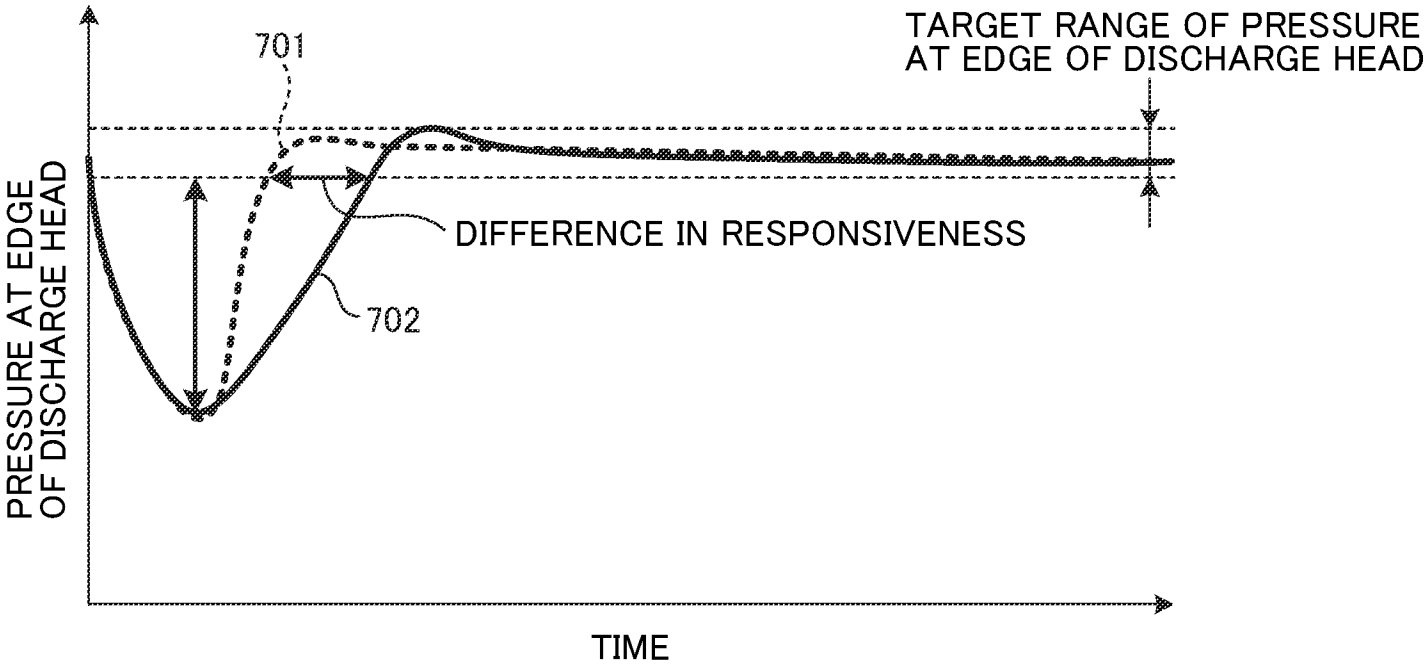
FIG. 8 is a graph illustrating the response characteristics of the pressure in the discharge head of the liquid discharge device according to the embodiment illustrated in FIG. 1.

FIG. 8 is a graph illustrating the response characteristics of the pressure in the discharge head of the liquid discharge device according to the present embodiment. The effects on the responsiveness of the pressure of the ink at the edge of the discharge head 200 of the liquid discharge device 10 according to the present embodiment is now described, with reference to FIG. 8.

As described above, the liquid discharge device 1000 according to the comparative example adjusts the outputs of the two pumps (the first liquid feed pump 1214 and the second liquid feed pump 1217), to control the flow rate of the ink flowing into the discharge head 1200 so that the pressure of the ink at the edge of the discharge head 1200 becomes constant.

In the circulation path of the liquid discharge device 1000, in a case where stress is applied from outside to cause a fluctuation in the pressure of the ink at the edge of the discharge head 1200, a long time is required for the flow rate of the ink flowing into the discharge head 1200 to change, because the pump is located far from the discharge head 1200. Therefore, a long time is also required before the pressure becomes constant. An example of the response characteristics of the pressure of the ink at the edge of the discharge head 1200 in this case is illustrated as response characteristics 702 in FIG. 8.

In the liquid discharge device 10 according to the present embodiment, on the other hand, the flow regulator 218 is disposed between the discharge head 200 and the junction of the bypass path 226 and the liquid path on the downstream side of the discharge head 200, as described above. With this arrangement, the flow rate of the ink flowing into the discharge head 200 is controlled to be constant. As a result, the distance between the flow regulator 218, which is a flow regulator, and the discharge head 200 to be controlled can be shortened. Because of this, the flow rate of the ink flowing into the discharge head 200 is quickly changed with an ink pressure fluctuation at the edge of the discharge head 200, so that the flow rate can be made constant. Thus, the pressure of the ink at the edge of the discharge head 200 can also be quickly made constant. The response characteristics of the pressure of the ink at the edge of the discharge head 200 in this case are response characteristics 701 illustrated in FIG. 8, and the responsiveness is improved compared with the response characteristics 702 of the liquid discharge device 1000 described above.

As described above, the liquid discharge device 10 according to the present embodiment includes the bypass path 226 that links the liquid path on the upstream side of the discharge head 200 to the liquid path on the downstream side not through the discharge head 200. Further, the first manifold tank 215 located below the discharge head 200 is opened to the atmosphere, and a flow regulator 218 is provided on the downstream side of the discharge head 200. With this arrangement, even if a disturbance occurs in the ink path of the liquid discharge device 10, and the flow rate of the ink changes, control is performed so that the flow rate of the ink flowing into the discharge head 200 becomes constant, and the pressure of the ink at the edge of the discharge head 200 also becomes constant. Accordingly, fluctuations in the pressure are reduced. Thus, in a printing operation by the printing unit 15 including the liquid discharge device 10, deterioration of image quality can be reduced. Further, compared with the liquid discharge device 1000 according to the comparative example, a pump is omitted, and the flow regulator 218 that is smaller in size than the pump is adopted in place of the pump. Accordingly, the number of steps in development can be reduced, an increase in costs can be prevented, and the restrictions on the layout can be reduced.

Further, in the liquid discharge device 10, the flow regulator 218 is disposed between the discharge head 200 and the junction of the bypass path 226 and the liquid path on the downstream side of the discharge head 200. As a result, the distance between the flow regulator 218, which is a flow regulator, and the discharge head 200 to be controlled can be shortened. Because of this, the flow rate of the ink flowing into the discharge head 200 is quickly changed with an ink pressure fluctuation at the edge of the discharge head 200, so that the flow rate can be made constant. Thus, the pressure of the ink at the edge of the discharge head 200 can also be quickly made constant.

First Variation

Figure 9:
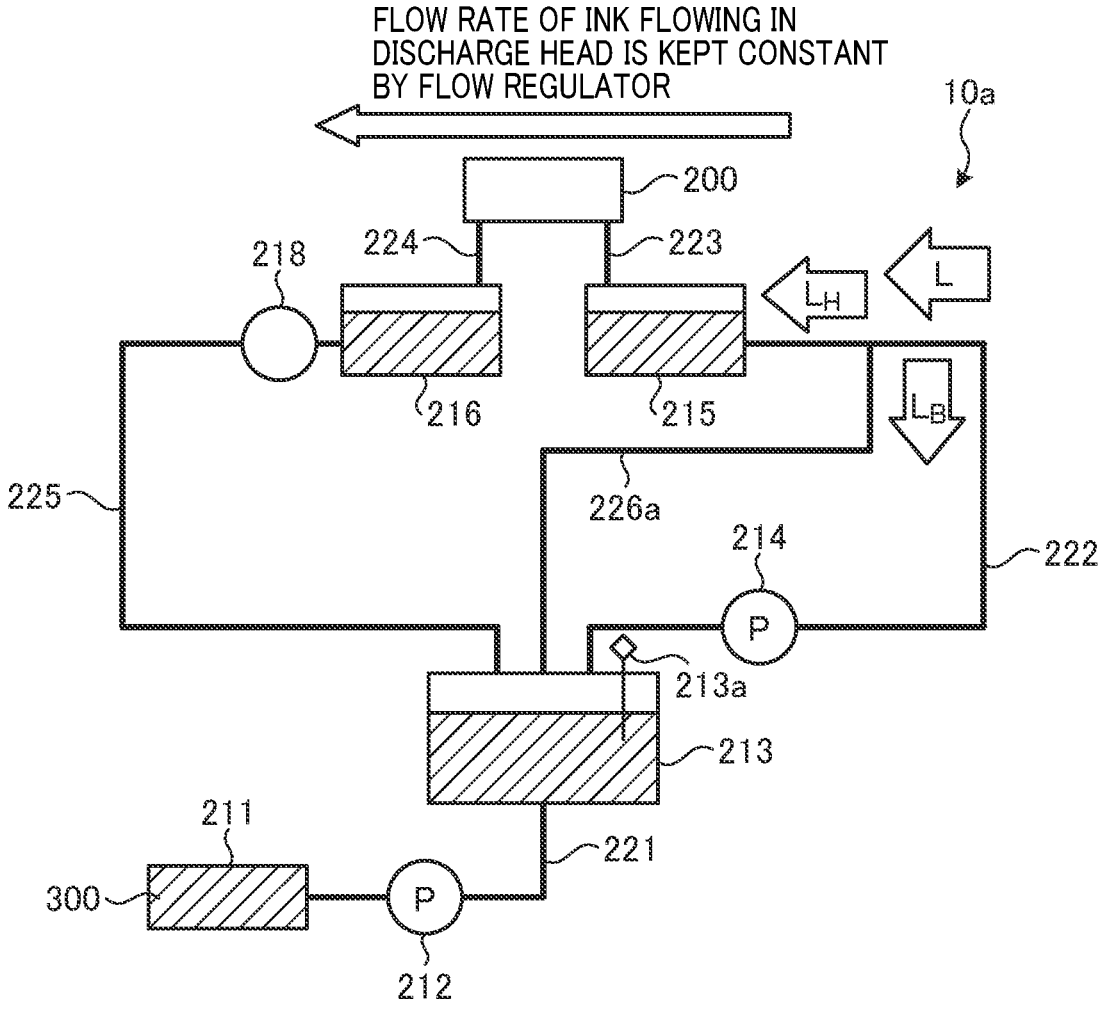
FIG. 9 is a diagram illustrating an example of the configuration of the ink circulation path of the liquid discharge device according to a first variation.

FIG. 9 is a diagram illustrating an example of the configuration of the ink circulation path of a liquid discharge device according to a first variation of the present embodiment. Referring to FIG. 9, the differences between a liquid discharge device 10*a* according to the first variation of the present embodiment and the above described liquid discharge device 10 are mainly described.

As illustrated in FIG. 9, the liquid discharge device 10*a* according to the first variation includes a main tank 211, a supply feed pump 212, a buffer tank 213, a liquid feed pump 214 (a first liquid feeder), a first manifold tank 215 (a supply tank), a discharge head 200, a second manifold tank 216, a flow regulator 218 (an example of a flow regulator), and a bypass path 226*a* (an example of a branch path). The configuration of the liquid discharge device 10*a* is the same as the configuration of the liquid discharge device 10 described above, except for the bypass path 226*a*. The liquid discharge device 10*a* is disposed in the printing unit 15 illustrated in FIG. 1 described above.

The bypass path 226*a* links the buffer tank 213 to the upstream side of the first manifold tank 215 in the liquid path 222 formed with a tube, and causes part of the ink flowing into the first manifold tank 215 to bypass the first manifold tank 215 and flow into the buffer tank 213.

With the configuration of the liquid discharge device 10*a* as described above, a fluctuation in the flow rate of the ink due to a disturbance is quickly reduced, so that the flow rate can be made constant, as in the liquid discharge device 10 described above.

Further, in the liquid discharge device 10*a* according to this variation, the bypass path 226*a* is connected directly to the buffer tank 213, not to the downstream side of the flow regulator 218 in the liquid path 225 formed with a tube. This eliminates the need to connect one end of the bypass path 226*a* to the liquid path 225. Thus, the degree of freedom in the layout of the bypass path 226*a* can be increased, and the number of steps in design can be reduced.

Second Variation

Figure 10:
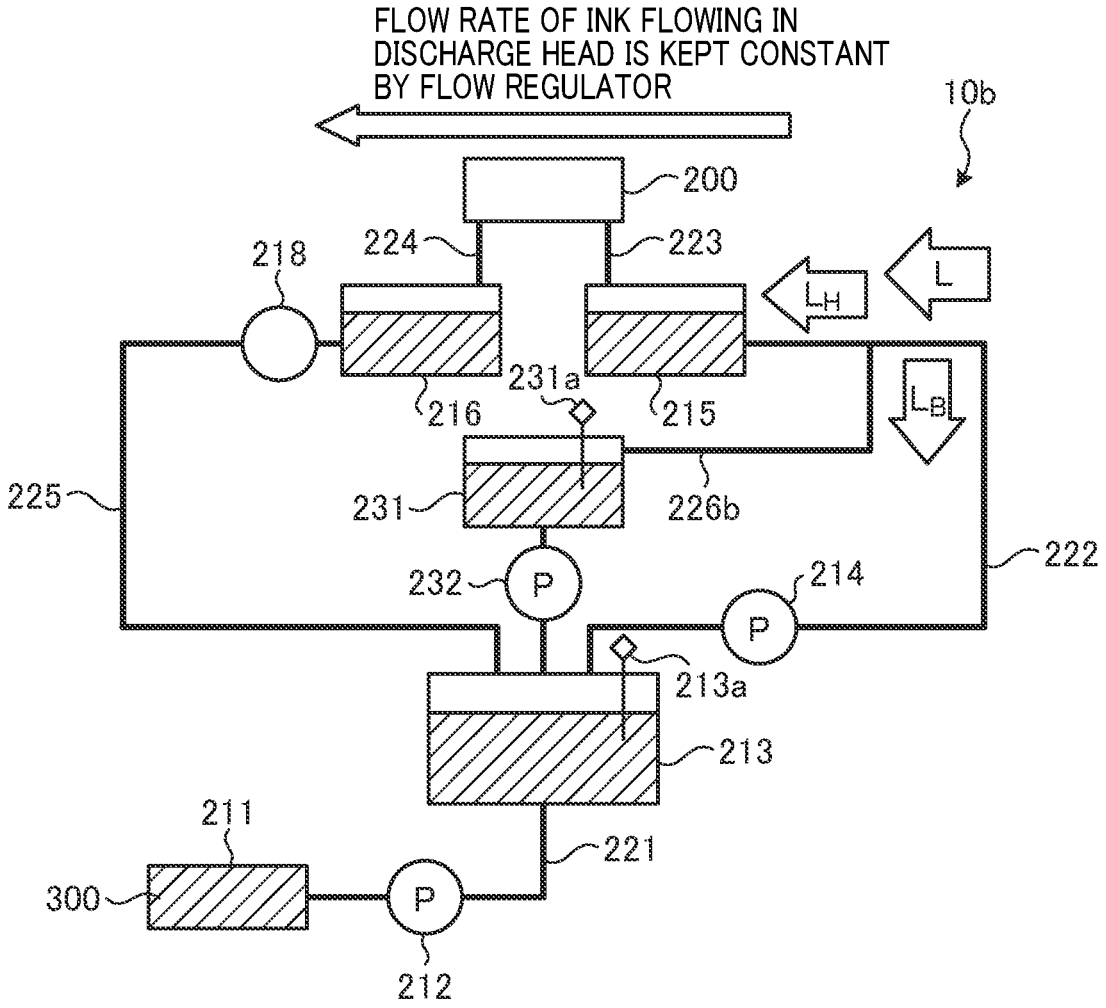
FIG. 10 is a diagram illustrating an example of the configuration of the ink circulation path of the liquid discharge device according to a second variation.

FIG. 10 is a diagram illustrating an example of the configuration of the ink circulation path of a liquid discharge device according to a second variation. Referring to FIG. 10, the differences between a liquid discharge device 10*b* according to the second variation of the present embodiment and the above described liquid discharge device 10*a* according to the first variation are mainly described.

As illustrated in FIG. 10, the liquid discharge device 10*b* according to the second variation includes a main tank 211, a supply feed pump 212, a buffer tank 213, a liquid feed pump 214 (a first liquid feeder), a first manifold tank 215 (a supply tank), a discharge head 200, a second manifold tank 216, a flow regulator 218 (an example of a flow regulator), a bypass path 226*b* (an example of a branch path), a recovery tank 231, a liquid level sensor 231*a* (a first detector), and a recovery pump 232 (a second liquid feeder). The configuration of the liquid discharge device 10*b* is the same as the configuration of the liquid discharge device 10*a* described above, except for the bypass path 226*b*, the recovery tank 231, the liquid level sensor 231*a*, and the recovery pump 232. The liquid discharge device 10*b* is disposed in the printing unit 15 illustrated in FIG. 1 described above.

The bypass path 226*b* links the buffer tank 213 to the upstream side of the first manifold tank 215 in the liquid path 222, and causes part of the ink flowing into the first manifold tank 215 to bypass the first manifold tank 215 and flow into the buffer tank 213. In the bypass path 226*b*, the recovery tank 231 and the recovery pump 232 are disposed in this order from the upstream side.

The recovery tank 231 is a tank for storing ink having flowed into the bypass path 226*b*. The liquid level sensor 231*a* is a sensor that detects whether the amount of ink in the recovery tank 231 exceeds a predetermined amount (threshold amount).

In a case where the liquid level sensor 231*a* detects that the amount of ink in the recovery tank 231 exceeds the predetermined amount (threshold amount), the recovery pump 232 is driven to send the ink in the recovery tank 231 to the buffer tank 213.

With the configuration of the liquid discharge device 10*b* as described above, a fluctuation in the flow rate of the ink due to a disturbance is quickly reduced, so that the flow rate can be made constant, as in the liquid discharge device 10 described above.

Further, in a case where the liquid level sensor 231*a* detects that the amount of ink in the recovery tank 231 exceeds the predetermined amount (threshold amount), the ink in the recovery tank 231 is sent to the buffer tank 213 by the recovery pump 232. As a result, it is possible to more safely recover the ink flowing in the bypass path 226*b* into the buffer tank 213, compared with the liquid discharge device 10*a* according to the first variation.

Note that the liquid discharge devices 10, 10*a*, and 10*b* according to the above embodiment and the respective variations are not necessarily applied to the above described image forming apparatus 1 that prints an image on a recording medium such as a paper sheet, but may be applied to a fabricating apparatus such as a 3D printer that discharges a fabrication material as the ink onto a recording medium, to fabricate a three-dimensional image. In this case, in the fabricating apparatus, deterioration of the fabricating quality of a three-dimensional image due to a disturbance in the path of the ink (the fabrication material) can be reduced, and the restrictions on the layout and increase in the costs can be reduced.

Further, in the above embodiment and the respective variations, the program to be executed by the image forming apparatus 1 (the printing unit 15) is incorporated into a ROM or the like in advance before being provided. Further, the program to be executed by the image forming apparatus 1 (the printing unit 15) according to the above embodiment and the respective variations may be recorded in an installable format or an executable file on a computer-readable recording medium such as a compact disc read only memory (CD-ROM), a flexible disk (FD), a compact disc-recordable (CD-R), or a digital versatile disc (DVD). Alternatively, the program to be executed by the image forming apparatus 1 (the printing unit 15) according to the above embodiment and the respective variations may be stored in a computer connected to a network such as the Internet, and be downloaded via the network. Further, the program to be executed by the image forming apparatus 1 (the printing unit 15) according to the above embodiment and the respective variations may be provided or distributed via a network such as the Internet. Furthermore, the program to be executed by the image forming apparatus 1 (the printing unit 15) according to the above embodiment and the respective variations has a module configuration including at least one of the functional units, and the CPU (such as CPU 501) as actual hardware reads and executes the program from the above described storage device (such as the ROM 502), to load the respective functional units into the main storage device (such as the RAM 503) and generate the respective functions units.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge device comprising:

a storage tank configured to store a liquid;

a discharge head configured to discharge the liquid;

a liquid feeder configured to feed the liquid from the storage tank to the discharge head in a liquid feed direction;

a supply tank disposed upstream of the discharge head in the liquid feed direction and configured to store the liquid fed by the liquid feeder while being in a state open to atmosphere;

a liquid path configured to flow the liquid from the liquid feeder to the supply tank;

a flow regulator disposed downstream of the discharge head in the liquid feed direction and configured to control a flow rate of the liquid flowing into the discharge head; and a branch path connected to the liquid path that is configured to cause part of the liquid to branch from the liquid path, wherein the branch path connects an upstream side of the supply tank in the liquid feed direction to a downstream side of the flow regulator in the liquid feed direction to mitigate pressure fluctuations of the liquid at the discharge head as the flow regulator controls the flow rate of the liquid flowing into the discharge head.

2. The liquid discharge device according to claim 1, wherein the discharge head is disposed at a position higher than the supply tank.

3. The liquid discharge device according to claim 1, wherein the branch path at the downstream side of the flow regulator is connected to another liquid path disposed downstream of the flow regulator in the liquid feed direction.

4. The liquid discharge device according to claim 1, wherein the branch path at the downstream side of the flow regulator is connected to the storage tank.

5. The liquid discharge device according to claim 1, wherein the flow regulator controls the flow rate of the liquid flowing into the discharge head to be constant without receiving an instruction from an external device.

6. The liquid discharge device according to claim 1, wherein the flow regulator includes a flow control valve, and wherein the flow regulator detects the flow rate of the liquid flowing into the discharge head and controls opening of the flow control valve on basis of the flow rate detected.

7. The liquid discharge device according to claim 1, wherein the supply tank is formed of a flexible member.

8. The liquid discharge device according to claim 1, wherein the liquid path comprises a tube connecting the storage tank to the supply tank.

9. An image forming apparatus comprising the liquid discharge device according to claim 1.

10. A fabricating apparatus comprising the liquid discharge device according to claim 1.

11. A liquid discharge device comprising:

a storage tank configured to store a liquid;

a discharge head configured to discharge the liquid;

a liquid feeder configured to feed the liquid from the storage tank to the discharge head in a liquid feed direction;

a recovery tank;

a detector configured to detect an amount of the liquid in the recovery tank;

a supply tank disposed upstream of the discharge head in the liquid feed direction and configured to store the liquid fed by the liquid feeder while being in a state open to atmosphere;

a liquid path configured to flow the liquid from the liquid feeder to the supply tank;

a flow regulator disposed downstream of the discharge head in the liquid feed direction and configured to control a flow rate of the liquid flowing into the discharge head;

another liquid feeder configured to feed the liquid in the recovery tank to the storage tank when the detector detects that the amount of the liquid in the recovery tank exceeds a threshold amount; and a branch path connected to the liquid path that is configured to cause part of the liquid to branch from the liquid path, wherein the branch path connects an upstream side of the supply tank in the liquid feed direction to the recovery tank to mitigate pressure fluctuations of the liquid at the discharge head as the flow regulator controls the flow rate of the liquid flowing into the discharge head.

12. The liquid discharge device according to claim 11, wherein the flow regulator controls the flow rate of the liquid flowing into the discharge head to be constant without receiving an instruction from an external device.

13. The liquid discharge device according to claim 11, wherein the flow regulator includes a flow control valve, and wherein the flow regulator detects the flow rate of the liquid flowing into the discharge head and controls opening of the flow control valve on basis of the flow rate detected.

14. The liquid discharge device according to claim 11, wherein the supply tank is formed of a flexible member.

15. An image forming apparatus comprising the liquid discharge device according to claim 12.

16. A fabricating apparatus comprising the liquid discharge device according to claim 11.

* * * * *